US005659922A

United States Patent [19]

Louis

[11] Patent Number: 5,659,922

[45] Date of Patent: Aug. 26, 1997

[54] DIRT CUP LATCHING ARRANGEMENT

[75] Inventor: Jeffrey S. Louis, Canal Fulton, Ohio

[73] Assignee: The Hoover Company, North Canton, Ohio

[21] Appl. No.: 596,630

[22] Filed: Feb. 5, 1996

[51] Int. Cl.[6] ..... A47L 9/10; A47L 9/20

[52] U.S. Cl. ..... 15/350; 15/344; 15/352; 55/433; 403/321

[58] Field of Search ..... 15/344, 347, 349, 15/350, 351, 352; 55/429, 432, 433; 403/321, 324, 326

[56] References Cited

U.S. PATENT DOCUMENTS

| | | | |
|---|---|---|---|
| 1,639,878 | 8/1927 | Bentrott . | |
| 1,727,921 | 9/1929 | Adams . | |
| 1,916,006 | 6/1933 | Leathers . | |
| 2,020,120 | 11/1935 | Leathers . | |
| 3,245,698 | 4/1966 | Fromknecht . | |
| 4,405,346 | 9/1983 | Tschudy et al. . | |
| 4,566,149 | 1/1986 | Fitzwater . | |
| 4,644,605 | 2/1987 | Joss et al. | 15/350 |
| 4,655,582 | 4/1987 | Richmond et al. | 15/352 |
| 4,928,347 | 5/1990 | Krasznai et al. | 15/352 |
| 4,993,106 | 2/1991 | Hult et al. | 15/350 |
| 5,107,567 | 4/1992 | Ferrari et al. . | |
| 5,500,978 | 3/1996 | Levine | 15/352 |

FOREIGN PATENT DOCUMENTS

| | | | |
|---|---|---|---|
| 681439 | 3/1964 | Canada . | |
| 1450445 | 3/1969 | Germany . | |
| 2401429 | 7/1974 | Germany | 15/344 |

*Primary Examiner*—David Scherbel
*Assistant Examiner*—Terrence Till
*Attorney, Agent, or Firm*—A. Burgess Lowe; Richardson B. Farley

[57] ABSTRACT

A stick cleaner is provided with a dirt cup that can be inserted partially into the housing of the stick cleaner and swung to a fully mounted position by an automatic camming action. The dirt cup includes a latching mechanism which also cammingly engages a latch hook on the suction tube of the stick cleaner to maintain the dirt cup in an assembled position.

13 Claims, 5 Drawing Sheets

DIRT CUP LATCHING ARRANGEMENT

BACKGROUND OF THE INVENTION

1. Field of the Invention

This invention relates to vacuum cleaners and, more particularly, to a dirt cup arrangement utilizable with a stick-type vacuum cleaner.

2. Summary of the Prior Art

The use of a dirt cup arrangement in a vacuum cleaner, including stick cleaners, to receive and store suctioned dirt is old and well known. It is also known provide a mounting and latching arrangement for a dirt cup which attempts to ease its removal and also its cammed latching into engaged position in a stick cleaner. It is even known in the floor care art to utilize a dirt receiving flow tube for the mounting of a portion of the latching mechanism with its companion latching parts on the receiving container. It would be advantageous to combine all these elements in a stick cleaner with an improved latching and camming to thereby accrue their benefits and with these benefits obtained from a clean, simplified design.

Accordingly, it is an object of this invention to provide an improved, simplified latching mechanism for a dirt cup which is partly mounted with the cleaner suction tube.

It is a further object of the invention to provide easy camming swinging and latching of a dirt cup in a vacuum cleaner.

It is an additional object of the invention to provide effective camming sealing of a dirt cup in a vacuum cleaner.

It is a still further object of the invention to provide a simplified dirt cup arrangement in a stick cleaner.

SUMMARY OF THE INVENTION

The invention comprehends a dirt cup arrangement suitable, primarily, for a stick cleaner but utilizable in other cleaner arrangements. The cleaner includes a nozzle suction tube extending upwardly from a conventional floor nozzle (not shown) to which a dirt cup is confluently connected. Air flow is through the dirt cup upwardly into a motor-fan system for eventual discharge to atmosphere. A bag shaped filter is disposed between the dirt cup and motor-fan system to insure that dirt particles settle out in the dirt cup.

The dirt cup seals telescopically and upwardly against the stick cleaner housing and latches at its bottom to maintain it in mounted, sealed relationship with the remainder of the stick cleaner.

The latch comprises an integral downward facing latch hook formed on the suction tube and a unitary latch piece including a latch part, a spring finger part and finger release part, all mounted for slight pivotal movement on the bottom of the dirt cup. The dirt cup latch piece is oriented upwardly to engage under the suction tube latch hook when the dirt cup is in mounted position.

Easy mounting of the dirt cup is occasioned by first telescopically engaging the dirt cup with the stick cleaner housing and then swinging the dirt cup bottom towards the latch hook on the stick cleaner suction tube. As the dirt cup latch piece engages the suction tube latch hook it is cammed downwardly, passing past the suction tube latch hook and then springing upwardly as it clears at its outer edge to engage in the hook portion of the suction tube latch hook.

This movement of the dirt cup, both, as to its mounting and camming latching, enables easy air tight assembly of the dirt cup to the stick cleaner. This is aided by a dirt cup camming surface, integral with the suction tube latch hook, that engages a bottom portion of the dirt cup to urge it upwardly as it swings inwardly so that dirt cup sealing is insured.

Removal of the dirt cup is also facilitated by manipulation of the dirt cup latch finger piece upwardly. This compresses the spring finger and permits the dirt cup and its latch piece to swing to a disengaged position.

BRIEF DESCRIPTION OF THE DRAWINGS

Reference now may be had to the accompanying Drawings for a better understanding of the invention, both as to its organization and function, with the illustration being only exemplary, and in which.

DETAILED DESCRIPTION OF THE PREFERRED EMBODIMENT

Figure 1:
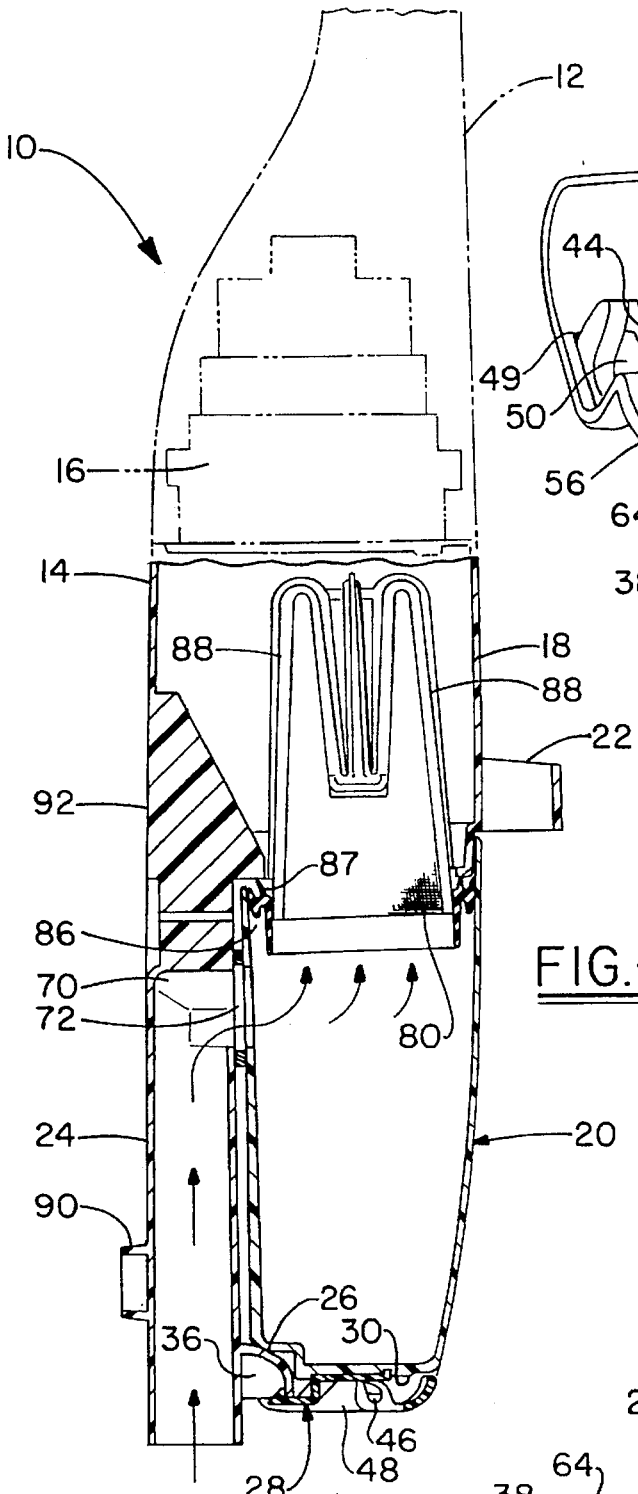
FIG. 1 is a cross-sectional elevational view, partly in phantom, generally, of a stick cleaner that incorporates the invention.
Figure 5:
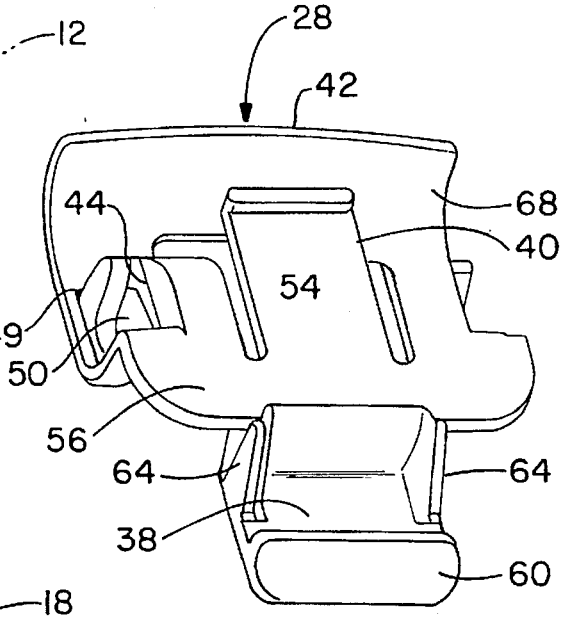
FIG. 5 is a perspective view of the dirt cup latch taken on its top side.
Figure 4:
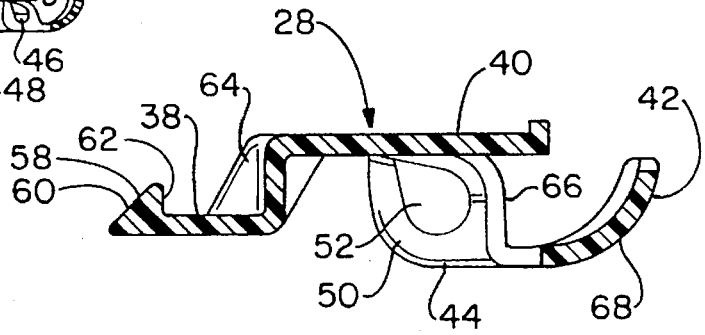
FIG. 4 is a cross-sectional side elevational view of the dirt cup latch.
Figure 2:
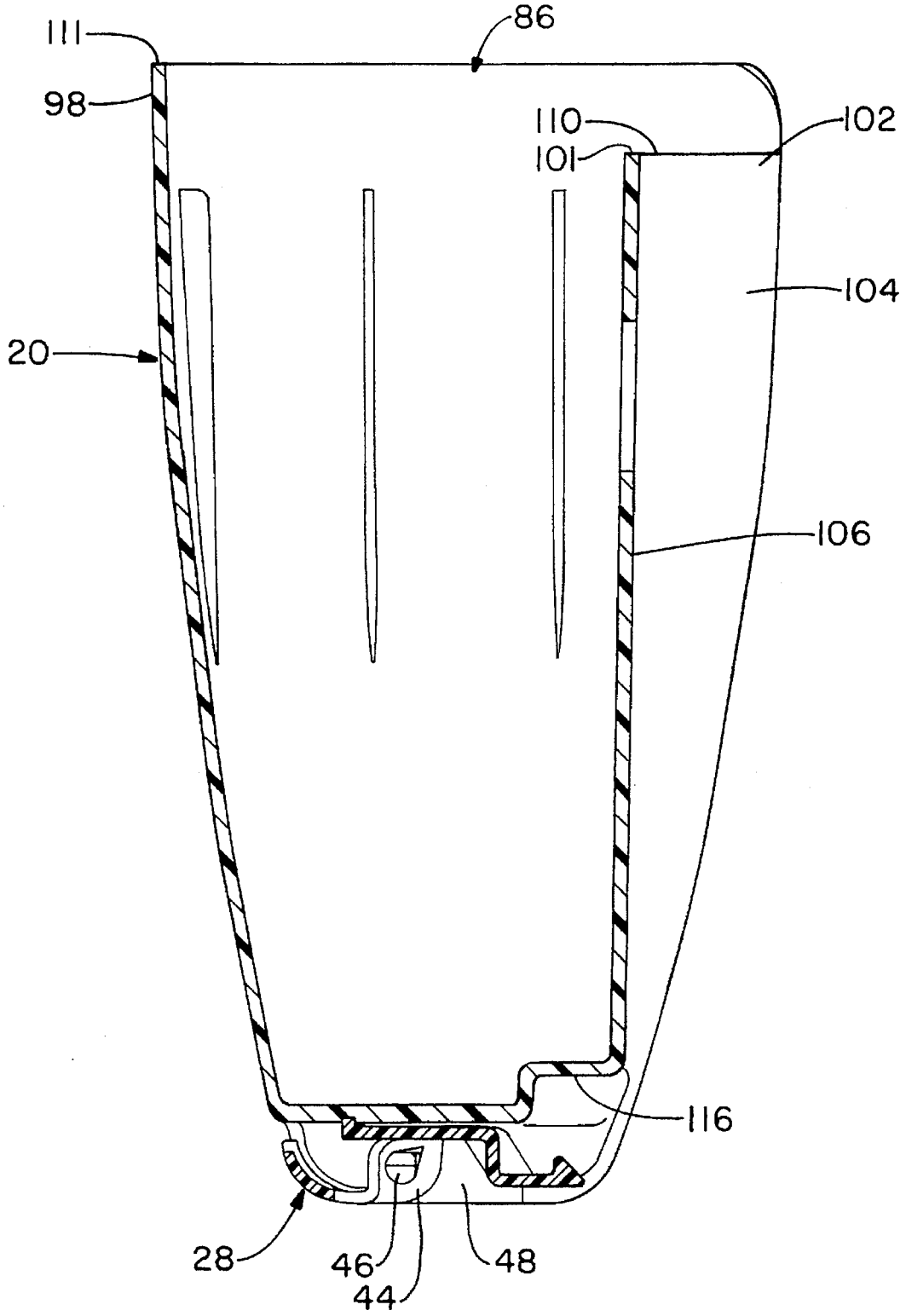
FIG. 2 is a cross-sectional elevational view of the dirt cup and its latch.
Figure 3:
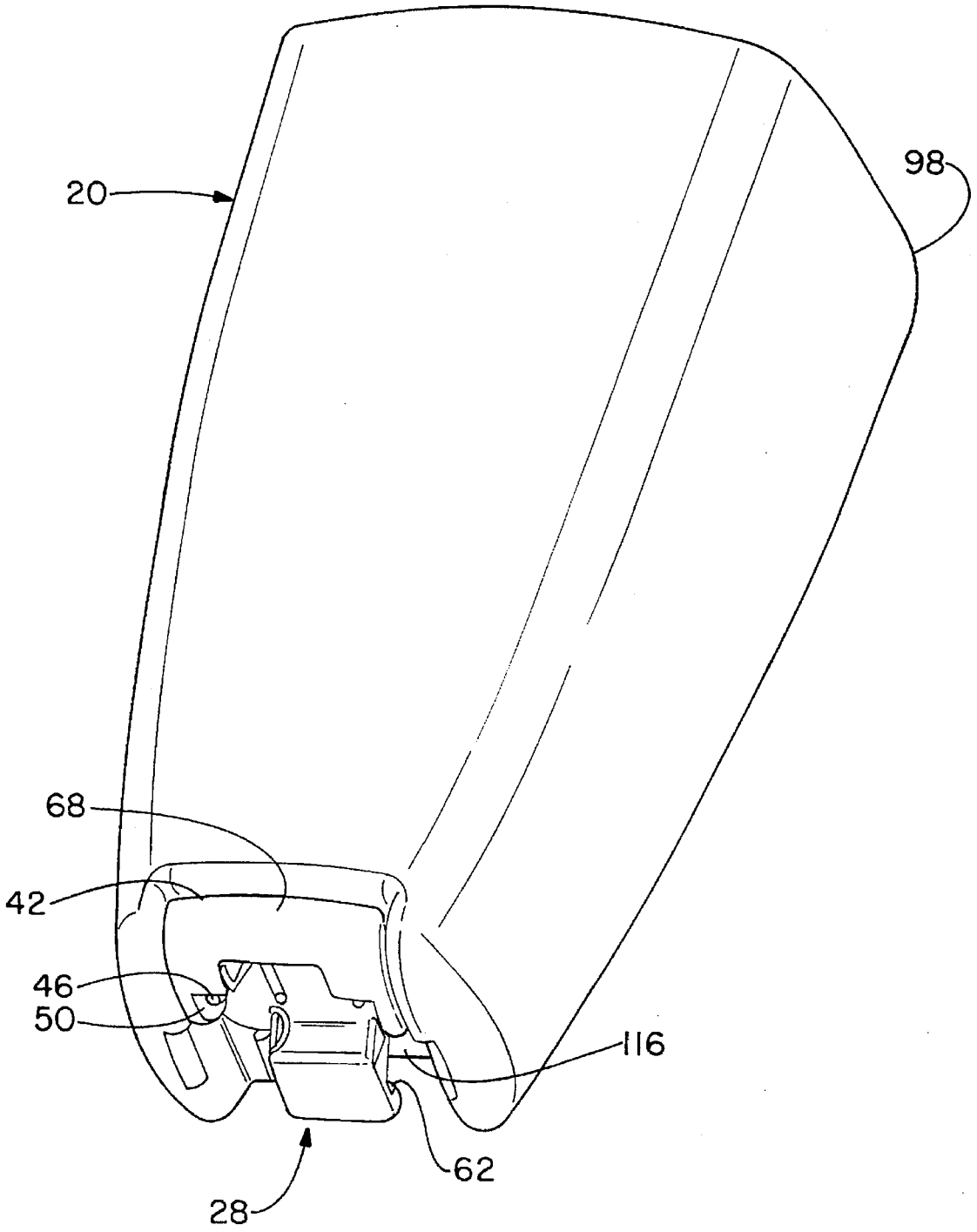
FIG. 3 is a perspective view of the dirt cup taken looking upwardly towards its bottom and showing the dirt cup latch.

Referring now specifically to the Drawings, there is shown a stick cleaner 10 having a front upper housing section 12 and an intermediate and rear housing section 14 joined together axially along a line (not shown) adjacent and above a motor-fan system 16 mounted within the front housing section 12 and intermediate and rear housing section 14. A lower portion 18 of intermediate and rear housing section 14 mounts a dirt cup 20. Lower portion 18 of intermediate and rear housing section 14 includes on its front side an integral carrying handle 22 adjacent the top of the dirt cup 20 and located conveniently for the operator of the stick cleaner 10. Intermediate and rear housing section 14 also includes at its rearward and lower portions an integral suction tube 24 which, conventionally, extends upwardly from a floor contacting suction nozzle (not shown). A handle (not shown) may also be conventionally mounted at the top of the joinder of housing sections 12, 14. This completes the description of the generalized outline structure of the hand held cleaner 10.

The dirt cup 20 is latched to the lower portion 18 of rear and intermediate housing section 14 by means of a latch hook 26 that is made integral with the suction tube 24 and a latch 28 mounted on a bottom 30 of the dirt cup 20. They interengage when the dirt cup 20 is in operative dirt collecting condition.

The latch hook 26 takes the form of a hook portion 32 having a downwardly depending locking wall 34, with the hook portion 32 disposed between two integral end walls 36, 36 which add strength and rigidity to the latch hook 26.

The dirt cup latch 28 is made in a one-piece plastic form. It includes generally a latching portion 38, a spring finger portion 40 and a operator finger contactable portion 42. Intermediate these last two portion is a latch boss pivot arrangement 44. The latch 28, through the latch boss pivot arrangement 44, is mounted pivotally to the dirt cup 20 by a pair of horizontally extending opposed pivot lugs 46, 46 integral with the bottom 30 of the dirt cup 20. These pivot lugs extend sidewardly from a pair of vertical walls 48, 48 formed in a depression 49 in the bottom 30 of the dirt cup 20 that lodges the latch 28. The pivot lugs 46, 46 and somewhat elongated curvilinear trapezium in cross-section due to the constraints of molding of the dirt cup 20.

The pivot lugs 46, 46 are received in trunnion portions 50, 50 of latch pivot boss arrangement 44 of latch 28. They are disposed on the outer edges of latch 28 and extend vertically upwardly to each include a sidewardly extending bore 52 for the reception of its respective lug 46. Between the trunnion portions 50, 50 is disposed a spring finger 54 of spring finger portion 40. It is in the form of a leaf spring which extends from a bottom plate 56 of spring finger portion 40 of the latch 28 so as to be disposed at least partly, slightly upwardly above the plane of a top side of the bottom plate 56 when latch 28 is in assembled position so as to resilient urge the latch 28 oppositely towards latched position.

The latching portion 38 of latch 28 includes a latch catch 58 intermediate the sides of latch 28 which normally extends into locking engagement with the latch hook 26 of suction tube 24 when the dirt cup 20 is mounted with the remainder of stick cleaner 10. The latching portion 38 of latch 28 has a forward, cam angled ramp 60 and a transverse vertical wall 62 that engages behind the similar portion of latch hook 26. The cam angled ramp 60 aids in locking engagement of the latch 28 and the latch hook 26 by deformingly pivoting the latching portion 38 of latch 28 downwardly to clear the hook portion 32 of latch hook 26 till it moves under and past the hook portion 32 of suction tube latch hook 26 during the mounting of the dirt cup 20. The latching portion 38 is then in position and unimpeded to move into locking relationship with the hook portion 32 of latch hook 26. A pair of integral vertical, end reinforcing walls 64, 64 provide rigidity to the latching portion 38.

As set out above, latch 28 also includes the operator finger contactable; portion 42. It extends integrally forwardly from the bottom plate 56 of latch 28 and intermediate its width. It includes a downwardly depending spacing wall 66 and a curvilinear portion 68 which forms the actual finger contacting surface for operator use. Upward urging of the curvilinear portion 68 of latch 28 compresses the spring finger 54 of spring finger portion 40, moving the latch portion 38 out of engagement with suction tube latch hook 26. The dirt cup 20 may then be demounted from the stick cleaner 10 by a downward and outward swinging motion.

Air flow to the dirt cup 20 and then to the motor-fan system 16 moves up the suction tube 24 to adjacent its top where the suction tube 24 is configured with a right angled bend 70 and an outlet port 72. Attached around the outlet port 72 is a rubberized seal 74 having a soft adhesive coating on one of its sides so as be easily mounted to a flat 76 formed in the outer surface of suction tube 24 at the outlet port 72. Air then moves into the dirt cup 20 through an entrance port 78 formed in it and then through a bag shaped filter 80 mounted at its top.

Figure 6:
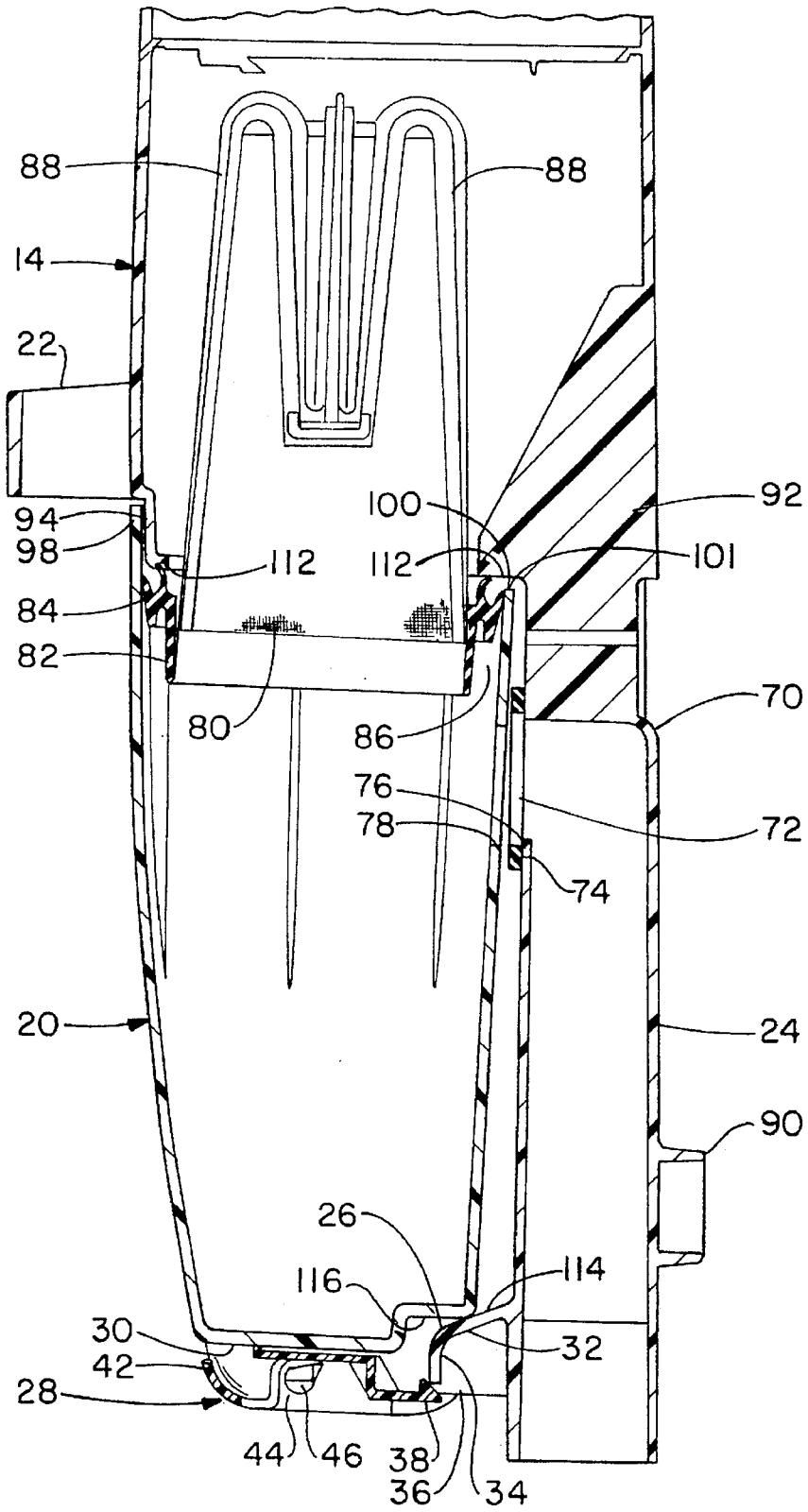
FIG. 6 is a view of the invention somewhat similar to FIG. 1 but showing the dirt cup and its latch immediately prior to engagement or immediately after disengagement from the suction tube latch catch.
Figure 7:
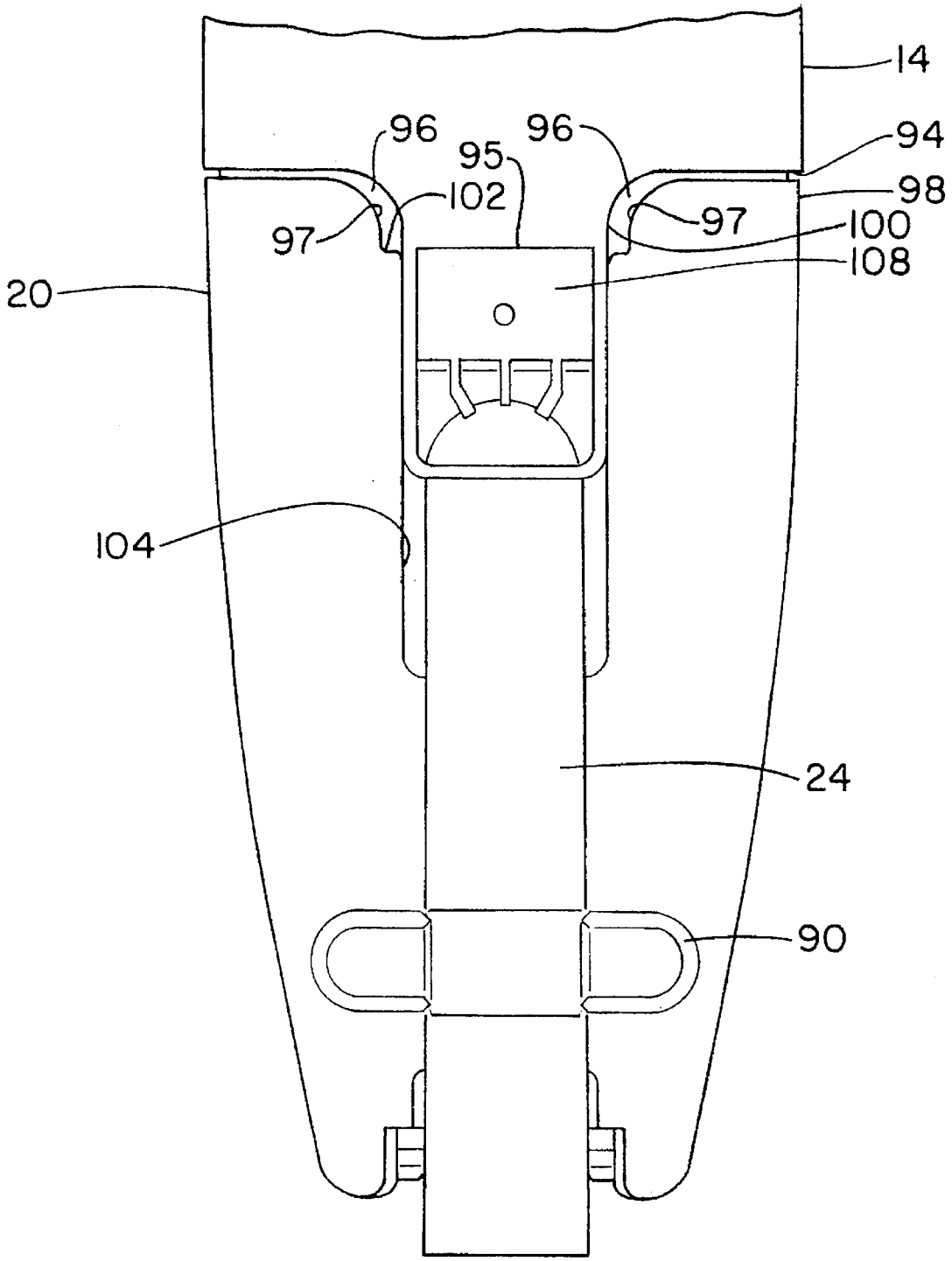
FIG. 7 is a partial elevational view of the rear side of the stick cleaner.

The bag shaped filter 80 (forming no part of this invention) is mounted to a bottom frame 82 (by sewing or the like) (not shown). The bottom frame 82 includes a generally cylindrical rubberized elastomeric seal 84 that seals downwardly in an open top 86 of dirt cup 20 and upwardly by a thin angularly and cylindrically arranged flange 87 that is forced abuttingly against portions of the rear and intermediate housing section 14. The bag shaped filter 80, when the stick cleaner 10 is operated extends upwardly from this frame and abuts against and stretches and partially unfolds (unfolded position not shown) a series of resilient plastic folded arms 88, and (only two shown) which are integral with bottom frame 82. The arms 88 serve as a bag shaker by reverting to their original position (FIG. 6) when the stick cleaner 10 is switched off.

Dirt is thereby expeditiously left in dirt cup 20, while clean filtered air passes upwardly to the motor-fan system 16 for eventual exhaust through exhaust slots (not shown) in the intermediate and rear housing section 14.

The suction tube 20 includes, conveniently, a cord wrap 90 that is also made integral with it. Above the upper end of suction tube 24 a series of horizontally spaced ribs 92 (only one shown), integral with rear and intermediate housing 14 add stiffness and rigidity to it.

To insure "tightness" of assembly of the stick cleaner 10, dirt cup 20 is securely mounted to rear and intermediate housing 14 at its top. This mounting partly takes the form of an inset rim 94, integral with and extending around a major part of the bottom portion of rear and intermediate housing portion 14. Near the top of the suction tube 24 and adjacent thereto, the inset rim 94 is shaped downwardly on each side in a curve 96, 96 that terminates approximately at a top surface border 95 of suction tube 24. This border and its surrounding surface is not inset at this location like the rim 94.

The dirt cup 20 has a similar outer, overlapping rim 98 that also includes curved border terminations 97, 97 in accordance with the curves 96, 96 of inset rim 94 to again provide an overlap. The overlapping rim 98 of the dirt cup 29 then overlays the inset rim 94 on rear and intermediate housing 14 in all areas except along the top sides of the dirt tube 24 and inwardly thereof.

The dirt cup 20, in this area, thereby engages upwardly against an abutting face 100 (shown fragmentarily, e.g., in FIG. 6) formed by a flat horizontal inset at the termination of inset rim 94. This inset is formed at the bottom termination of the curves 96, 96 and forms a face that extends along the top and the sides of the dirt tube 24. Against this face an inset termination 101 of the dirt cup 20 abuts.

The dirt cup 20 is relieved by a vertically extending relief 102 at its telescopic engagement and juncture with suction tube 24. This relief is substantially rectangular in horizontal cross-section and tapers towards the rear of the stick cleaner 10. It includes side walls 104, 104 which are spaced from each other by an inner wall 106. The suction tube 24 is received partly telescopically therein along its extending height.

The suction tube 24 is largely tubular in nature and cylindrical in shape but at its upper end 108 it is rectangular in cross-section and only slightly smaller than the relief 102 in which it telescopes.

In accordance with the engagement of dirt cup 20 and intermediate and rear housing section 14, a top edge 110 of relief 102 of dirt cup 20 terminates short of a top edge 111 of its rim 98 to form the aforesaid inset termination 101 that which can be seen as having a pair of side and an internal surfaces abuttingly engaging against the face 100 so that there are no overlapping rims portions of the dirt cup 20. Both of the faces 100 and 101 are U-shaped in plan. This arrangement provides a functionally acceptable mounting overlap for the dirt cup 20 for most if its periphery and an abutting face mounting at the location of the top of the suction tube 24.

To insure that the dirt cup 20, when latched fully, engages the rear and intermediate housing section 14 of stick cleaner 10 with sealed integrity, a cam is formed in a fixed relationship to stick cleaner by utilizing, advantageously, a ramped portion 114 of suction tube latch hook 26 which abutting engages an inset portion 116 of dirt cup 20 when the dirt cup 20 is mounted on the stick cleaner 10. The ramp 114 and inset portion are both located, when assembled, at the bottom of the suction cleaner 10, intermediate the front and back sides of the dirt cup 20 when viewed, e.g., as in FIG. 1.

Camming of the dirt cup 20 upwardly results in a positive engagement of the face of the flange 87 of seal 84 against a face 112 formed by the bottom termination of the inset rim 94 of rear and intermediate housing section 14 and the face 100 formed on rear and intermediate housing section 14 adjacent the top termination of the suction tube 24. Since the seal 84 also seals downwardly against the dirt cup 20, leak tight integrity between the dirt cup 20 and the motor-fan system 16 is insured.

It should be clear from the description offered that all the objects of the invention have been accommodated. It should also be clear that many modifications to the preferred embodiment could be made which would still fall within its spirit and purview.

What is claimed:

1. A dirt cup arrangement for a vacuum cleaner including:

a) a cleaner housing portion;

b) a dirt cup mounted to said housing portion, defining a mounted position;

c) a suction tube attached to said housing portion;

d) a latch hook mounted on said suction tube;

e) a latch hook mounted with said dirt cup;

f) said dirt cup at least partially swinging to said mounted position with said housing portion;

g) one of said latch hook on said suction tube and said latch hook on said dirt cup cammingly deforming during said swinging to thereby latch with the other.

2. A dirt cup arrangement for a vacuum cleaner set out in claim 1 wherein:

a) one of said latch hooks includes;

(1) an integral latching portion, (2) an integral spring finger, and (3) a finger contacting portion; and b) said spring finger urging said latching portion towards said other latch hook when said dirt cup is assembled with said cleaner housing portion.

3. A dirt cup arrangement for a vacuum cleaner as set out in claim 1 wherein:

a) a ramped camming surface is provided with one of said cleaner housing portion and said dirt cup;

b) said ramped camming surface engaging a portion on the other of said cleaner housing portion and said dirt cup during said swinging of said dirt cup;

c) whereby said dirt cup is cammed to said mounted position.

4. The dirt cup arrangement as set out in claim 3 wherein:

a) said ramped camming surface is formed on one of said latch hooks.

5. The dirt cup arrangement of claim 1 wherein:

a) said latch hook on said suction tube is made integral therewith.

6. The dirt cup arrangement of claim 1 wherein:

a) said housing portion includes a member having a seal;

b) said seal seals with a top portion of said dirt cup and a lower portion of said cleaner housing portion to provide sealing integrity between said dirt cup and said cleaner housing portion.

7. The dirt cup arrangement of claim 1 wherein:

a) said vacuum cleaner is a stick cleaner.

8. The dirt cup arrangement of claim 1 wherein:

a) said dirt cup and said cleaner housing portion at least partially overlap in assembled condition.

9. The dirt cup arrangement of claim 8 wherein:

a) said dirt cup and said cleaner housing portion at least partially abut in assembled condition.

10. A latch arrangement for a vacuum cleaner having a dirt cup and a housing including:

a) a latch hook mounted on a downwardly extending suction tube attached to said housing of said vacuum cleaner;

b) a latch hook mounted on said dirt cup;

c) one of said latch hooks including a camming means for aiding in securely mounting said dirt cup to said vacuum cleaner.

11. The latch arrangement for a vacuum cleaner having a dirt cup and a housing as set out in claim 10 wherein:

a) said camming means aids in engagement of said latch hooks.

12. The latch arrangement for a vacuum cleaner having a dirt cup and a housing as set out in claim 11 wherein:

a) said camming means urges said dirt cup into a mounted position with said vacuum cleaner.

13. The latch arrangement for a vacuum cleaner having a dirt cup and a housing as set out in claim 12 wherein:

a) said camming means forms a part of one of said latch hooks;

b) said dirt cup extends upwardly from said latch hooks; and said camming means is provided by an upwardly disposed ramp surface on said one of said latch hooks.

* * * * *